US009868283B2

(12) United States Patent
Misumi et al.

(10) Patent No.: US 9,868,283 B2
(45) Date of Patent: Jan. 16, 2018

(54) LIQUID DISCHARGE HEAD CLEANING METHOD AND LIQUID DISCHARGE APPARATUS

(71) Applicant: CANON KABUSHIKI KAISHA, Tokyo (JP)

(72) Inventors: Yoshinori Misumi, Tokyo (JP); Maki Kato, Fuchu (JP); Yuzuru Ishida, Yokohama (JP); Akio Goto, Tokyo (JP); Norihiro Yoshinari, Kawasaki (JP); Takahiro Matsui, Yokohama (JP); Ichiro Saito, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/253,432

(22) Filed: Aug. 31, 2016

(65) Prior Publication Data

US 2017/0066238 A1 Mar. 9, 2017

(30) Foreign Application Priority Data

Sep. 7, 2015 (JP) ..... 2015-176065

(51) Int. Cl.

*B41J 2/14* (2006.01)
*B41J 2/165* (2006.01)
*B41J 2/17* (2006.01)

(52) U.S. Cl.

CPC ..... *B41J 2/14072* (2013.01); *B41J 2/16517* (2013.01); *B41J 2/16526* (2013.01); *B41J 2/16505* (2013.01); *B41J 2/1707* (2013.01); *B41J 2/1714* (2013.01)

(58) Field of Classification Search

None

See application file for complete search history.

(56) References Cited

U.S. PATENT DOCUMENTS 8,721,050 B2 * 5/2014 Ishida ..... B41J 2/14427 347/56

FOREIGN PATENT DOCUMENTS

JP 2008-105364 A 5/2008

* cited by examiner

*Primary Examiner* — Lisa M Solomon

(74) *Attorney, Agent, or Firm* — Canon U.S.A., Inc. IP Division

(57) ABSTRACT

A method of cleaning a liquid discharge head, which includes a heat generating resistor that generates thermal energy for discharging a liquid and a covering portion covering the heat generating resistor, includes alternately performing a first voltage application process and a second voltage application process multiple times, and reducing energy applied in the second voltage application process. The first voltage application process includes applying voltage between the covering portion and an electrode through the liquid to dissolve the covering portion in the liquid. The second voltage application process includes reversing relative polarities of the covering portion and the electrode in the first voltage application process and applying voltage between the covering portion and the electrode. Energy applied in the second voltage application process is reduced such that the energy applied is less than energy applied in the first voltage application process of an immediately preceding time.

19 Claims, 11 Drawing Sheets

LIQUID DISCHARGE HEAD CLEANING METHOD AND LIQUID DISCHARGE APPARATUS

BACKGROUND OF THE INVENTION

Field of the Invention

Embodiments of the present invention relate to a method of cleaning a liquid discharge head that discharges a liquid and relates to a liquid discharge apparatus.

Description of the Related Art

Inkjet printing is a method of discharging a liquid, such as ink, from discharge ports arranged in an inkjet head (also referred to as a "liquid discharge head") and depositing the liquid on a recording medium, such as a sheet, to achieve printing. An inkjet printing system for discharging a liquid using bubbling of the liquid caused by thermal energy generated from heat generating resistors can achieve high-quality image and high-speed printing.

A typical liquid discharge head includes discharge ports, a flow passage that communicates with the discharge ports, and heat generating resistors that generate thermal energy to be used to discharge a liquid. Each heat generating resistor is formed by a heat generating resistive layer and an electrode for supplying power to the layer. The heat generating resistor is covered with an insulating layer formed of, for example, silicon nitride, thus providing insulation between the liquid and the heat generating resistor.

The liquid in the flow passage is in contact with part located so as to correspond to the heat generating resistor, so that the liquid is heated by this part. When the liquid is discharged, the part is exposed to a high temperature and experiences multiple effects, such as cavitation impact caused by bubbling and shrinkage of the liquid and chemical action of the liquid. To protect the heat generating resistor from the cavitation impact and the chemical action of the liquid, an anti-cavitation layer including a covering portion that covers the heat generating resistor is provided. The temperature of the surface of the covering portion is increased up to approximately 700° C. In addition, the surface of the covering portion is in contact with the liquid. The covering portion is therefore required to have good film properties in terms of, for example, thermal resistance, mechanical characteristics, chemical stability, and alkali resistance.

Furthermore, the following phenomenon occurs: high-temperature heating causes a coloring material, additives and so on contained in the liquid to be decomposed into molecules and the molecules change to a poorly soluble substance called "kogation". If kogation is physically adsorbed onto the surface of the covering portion, heat will be unevenly conducted from the heat generating resistor to the liquid, resulting in unstable bubbling.

Japanese Patent Laid-Open No. 2008-105364 discloses a method of cleaning a head by dissolving the surface of a covering portion, formed of iridium or ruthenium, in a liquid using an electrochemical reaction to remove kogation. Specifically, voltage is applied so that the covering portion located so as to correspond to a heat generating resistor serves as a positive electrode and an electrode located at a position different from the covering portion in a flow passage serves as a negative electrode, thus dissolving the surface of the covering portion in the liquid to remove kogation deposited on the surface. If such voltage application is continued, components contained in the liquid will be deposited on the surface of the covering portion. To prevent the deposition, voltage is applied while the polarities of the electrodes relative to the liquid are reversed as described in Japanese Patent Laid-Open No. 2008-105364.

However, after cleaning using constant voltage application with constant duration while reversing the positive and negative polarities of the electrodes as described in Japanese Patent Laid-Open No. 2008-105364, pigment particles, serving as components contained in pigment ink, remain adsorbed on the surface of the covering portion or the electrode. The adsorption of the pigment particles on the surface of the covering portion may result in poor heat conduction to the liquid. Unfortunately, the liquid may be discharged unstably. Furthermore, the adsorption of the pigment particles on the surface of the electrode may hinder an intended voltage from being applied to the surface of the covering portion in the next cleaning. It may be difficult to effectively remove kogation.

SUMMARY OF THE INVENTION

Embodiments of the present invention aim to eliminate or reduce the adsorption of a component contained in a liquid on the surface of a covering portion or an electrode during cleaning of a liquid discharge head.

According to an aspect of the present invention, a method of cleaning a liquid discharge head that includes a heat generating resistor that generates thermal energy for discharging a liquid and a covering portion covering the heat generating resistor, includes alternately performing a first voltage application process and a second voltage application process multiple times, wherein the first voltage application process includes applying voltage between the covering portion and an electrode through the liquid to dissolve the covering portion in the liquid, and wherein the second voltage application process includes reversing relative polarities of the covering portion and the electrode in the first voltage application process and applying voltage between the covering portion and the electrode, and reducing energy applied in the second voltage application process at least one time such that the energy applied is less than energy applied in the first voltage application process of an immediately preceding time.

Further features of the present invention will become apparent from the following description of exemplary embodiments with reference to the attached drawings.

DESCRIPTION OF THE EMBODIMENTS

Embodiments of the present invention will be described in detail below. The present invention is not limited to the embodiments which will be described below and can be applied to a liquid discharge head and a liquid discharge apparatus that are used for other applications so long as advantages of the embodiments of the present invention can be achieved.

<Liquid Discharge Apparatus>

Figure 11:
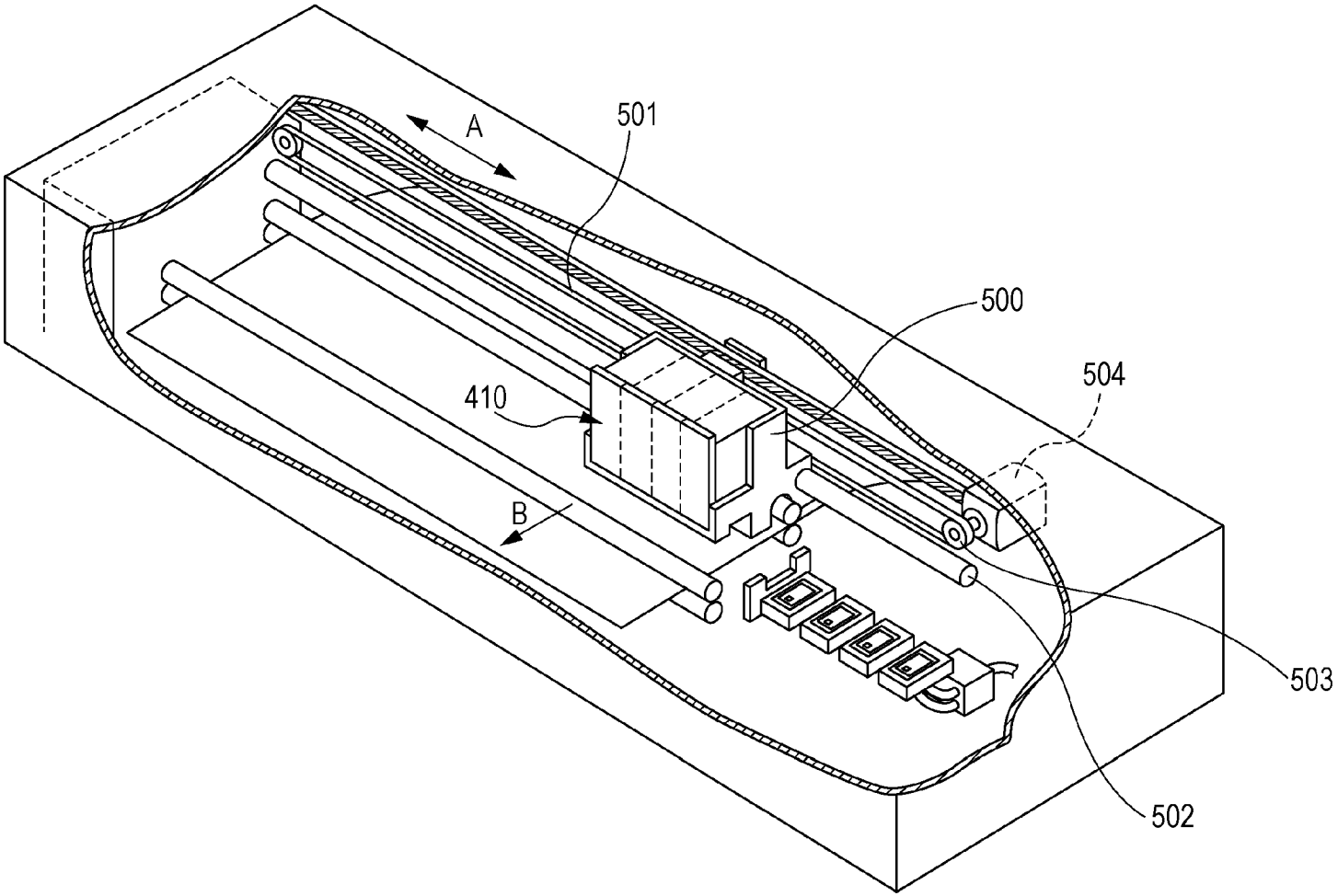
FIG. 11 is a perspective view of an inkjet printing apparatus according to an embodiment of the present invention.

FIG. 11 is a schematic perspective view of an inkjet printing apparatus, serving as a liquid discharge apparatus according to an embodiment of the present invention. A guide 502 supports a carriage 500, to which an inkjet head unit 410 is attached for printing. The guide 502, which is attached to a chassis, guides and supports the carriage 500 so that the carriage 500 is reciprocally scanned in a direction A perpendicular to a conveying direction B in which a recording medium is conveyed. The guide 502, integrated with the chassis, holds a rear end of the carriage 500 to provide a clearance between the inkjet head unit 410 and the recording medium.

The carriage 500 is driven through a timing belt 501 by a carriage motor 504 attached to the chassis. The timing belt 501 is stretched between and supported by idle pulleys 503.

In image formation on a recording medium with the above-described configuration, for a row position, the recording medium is conveyed and positioned by a roller pair (not illustrated) composed of a conveyance roller and a pinch roller. For a column position, the carriage 500 is moved in the direction A perpendicular to the conveying direction B by the carriage motor 504 to position the inkjet head unit 410 at a target image formation position. The positioned inkjet head unit 410 discharges ink to the recording medium. Printing in a main scanning direction and printing in a sub-scanning direction are alternately repeated, thus forming an image on the recording medium.

<Liquid Discharge Head>

Figure 1:
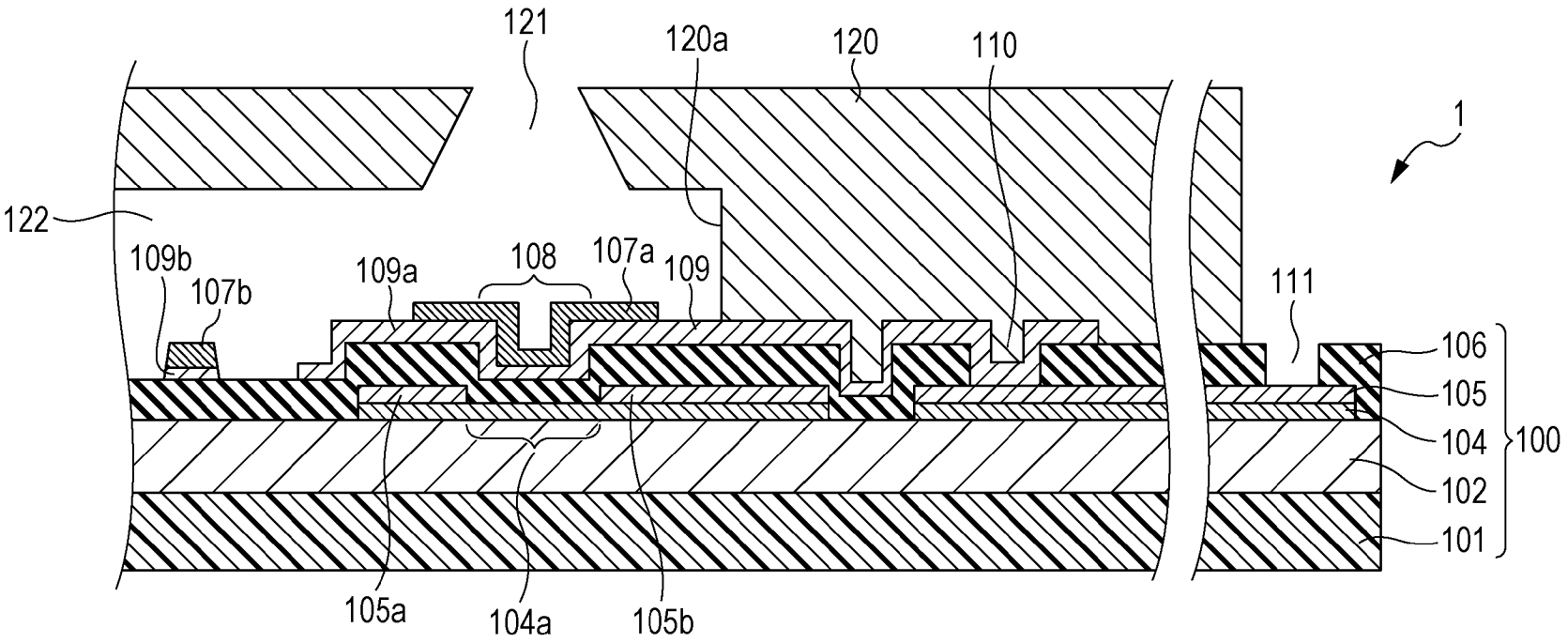
FIG. 1 is a schematic sectional view of a liquid discharge head according to an embodiment of the present invention.
Figure 2:
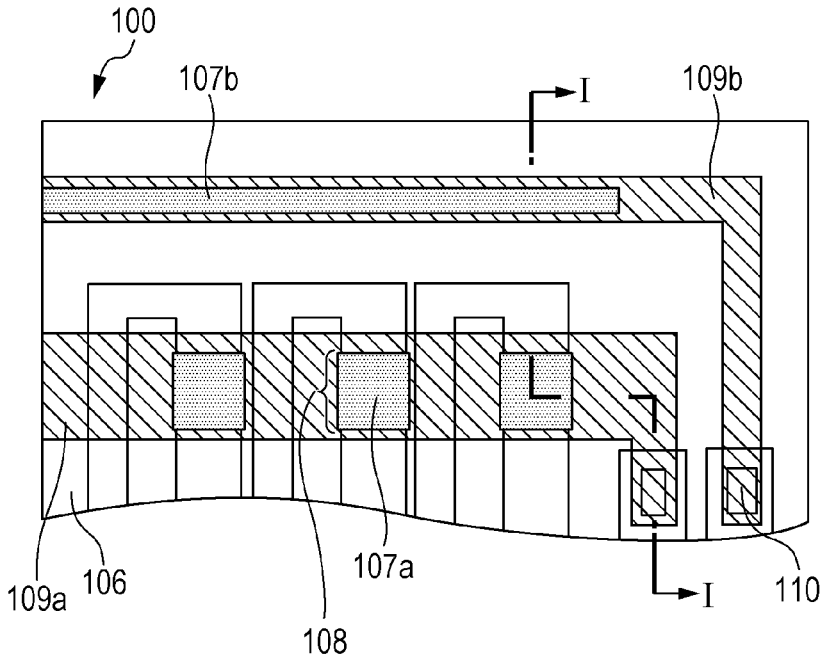
FIG. 2 is a schematic plan view of a liquid discharge head substrate in an embodiment of the present invention.

FIG. 1 is a schematic sectional view illustrating part of a liquid discharge head 1 and the part includes a heat generating resistor 104*a* and a discharge port 121. FIG. 2 is a schematic plan view of part of a liquid discharge head substrate 100 and the part includes the heat generating resistors 104*a*. In FIG. 2, a flow passage member 120 is omitted. FIG. 1 illustrates a section of the liquid discharge head 1 taken along the line I-I in FIG. 2.

A laminated structure of the liquid discharge head substrate 100 will now be described with reference to FIG. 1. The liquid discharge head substrate 100 includes a silicon base 101 overlaid with a heat accumulating layer 102 formed of, for example, a thermally oxidized film, a SiO film, or a SiN film. On the surface of the heat accumulating layer 102, a heat generating resistive layer 104 is disposed. The heat generating resistive layer 104 is overlaid with an electrode wiring layer 105, serving as a pair of electrode wiring lines 105*a* and 105*b* formed of metal, such as Al, Al—Si, or Al—Cu. A portion of the heat generating resistive layer 104 located between the pair of electrode wiring lines 105*a* and 105*b* functions as the heat generating resistor 104*a*. The electrode wiring layer 105 is connected to a drive element circuit (not illustrated) or an external power supply terminal (not illustrated) and is supplied with power from the outside. The liquid discharge head substrate 100 may have another laminated structure such that the heat generating resistive layer 104 and the electrode wiring layer 105 are interchanged with each other.

The heat generating resistive layer 104 and the electrode wiring layer 105 are covered with a layer 106. This layer 106 is formed of an insulating material, such as a SiO film or a SiN film, and functions as an insulating layer.

On the surface of the insulating layer 106, a contact layer 109 formed of tantalum is disposed. The contact layer 109 includes a first contact portion 109*a* and a second contact portion 109*b*, which are arranged apart. The first contact portion 109*a* is disposed at a position including a region corresponding to the heat generating resistor 104*a*. The second contact portion 109*b* is disposed in a flow passage 122.

On the surface of the contact layer 109 adjacent to the flow passage 122, a covering portion 107*a* formed of iridium or ruthenium is provided to cover the heat generating resistor 104*a*. The covering portion 107*a* is exposed in the flow passage 122. Part of the covering portion 107*a* corresponding to the heat generating resistor 104*a* serves as a heating portion 108 that applies thermal energy, generated by the heat generating resistor 104*a*, to the liquid. The heating portion 108 heats and bubbles the liquid, thereby discharging the liquid.

The covering portion 107*a* protects the heat generating resistor 104*a* from cavitation impact and chemical action of the liquid and also functions as an electrode for removing kogation deposited on the surface of the covering portion 107*a*. In addition, an electrode 107*b* formed of the same layer 107 as that of the covering portion 107*a* is provided in the flow passage 122. The electrode 107*b* functions as a different electrode from the covering portion 107*a* in a cleaning process of removing kogation deposited on the surface of the covering portion 107*a*. The covering portion 107*a* is not electrically connected to the electrode 107*b* while the liquid discharge head substrate 100 is in a single state. When voltage is applied between the covering portion 107*a* and the electrode 107*b* while the flow passage 122 is filled with a solution (e.g., ink) containing an electrolyte, current flows through the solution to cause an electrochemical reaction at the interface between the covering portion 107*a* and the solution, so that kogation can be removed.

Metals that are dissolved in the solution by an electrochemical reaction can be typically grasped from potential-pH diagrams of various metals. The covering portion 107*a* can be formed of a material that does not dissolve at a pH value of the solution but dissolves when voltage is applied so that the covering portion 107*a* is at a positive potential relative to the liquid and thus serves as an anode electrode (positive electrode). Specifically, iridium or ruthenium can be used as described above. If the covering portion 107*a* is a laminate including multiple layers, at least the outermost layer that faces the flow passage 122 can be formed of the above-described material. Although the electrode 107*b* may be formed of a different material or layer from that of the covering portion 107*a*, the electrode 107*b* can be readily formed of the same material or layer as that of the covering portion 107*a* as in the present embodiment.

The insulating layer 106 has a through hole 110. The covering portion 107*a* is electrically connected to the electrode wiring layer 105 with the contact layer 109 therebetween. The electrode wiring layer 105 extends up to ends of the liquid discharge head substrate 100. An end portion of the electrode wiring layer 105 in each end of the liquid discharge head substrate 100 serves as an external electrode 111 for electrical connection to the outside. The covering portion 107*a* is not in contact with the flow passage member 120. This prevents a reduction in tight contact between the flow passage member 120 and the substrate 100 if the covering portion 107*a* is dissolved by an electrochemical reaction.

The flow passage member 120 is provided on the same side of the liquid discharge head substrate 100 as the covering portion 107*a*. The flow passage member 120 has the discharge port 121. The liquid discharge head substrate 100 and the flow passage member 120 are joined such that the discharge port 121 is positioned so as to correspond to the heating portion 108 of the liquid discharge head substrate 100, thus forming the liquid discharge head 1. The flow passage member 120 has a wall 120*a* for the flow passage 122 communicating with the discharge port 121. The liquid discharge head substrate 100 is joined to the flow passage member 120 such that the wall 120*a* of the flow passage member 120 faces inward, thus defining the flow passage 122.

Figure 3:
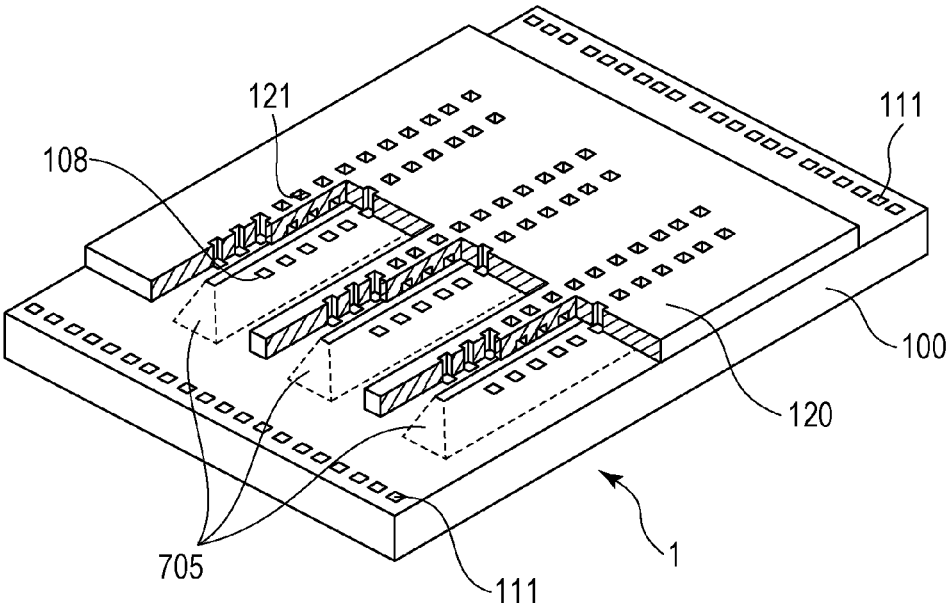
FIG. 3 is a schematic perspective view of the liquid discharge head according to an embodiment of the present invention.

FIG. 3 is a schematic perspective view of the liquid discharge head 1. The liquid discharge head 1 of FIG. 3 includes the liquid discharge head substrate 100 having three supply ports 705. A plurality of heating portions 108 are provided on both sides of each supply port 705 such that the heating portions 108 are arranged in a longitudinal direction of the supply port 705. The liquid to be discharged is supplied from the supply ports 705 through a plurality of flow passages 122 to the heating portions 108.

<Configuration of Driving Circuit and Timing Chart>

Figure 4:
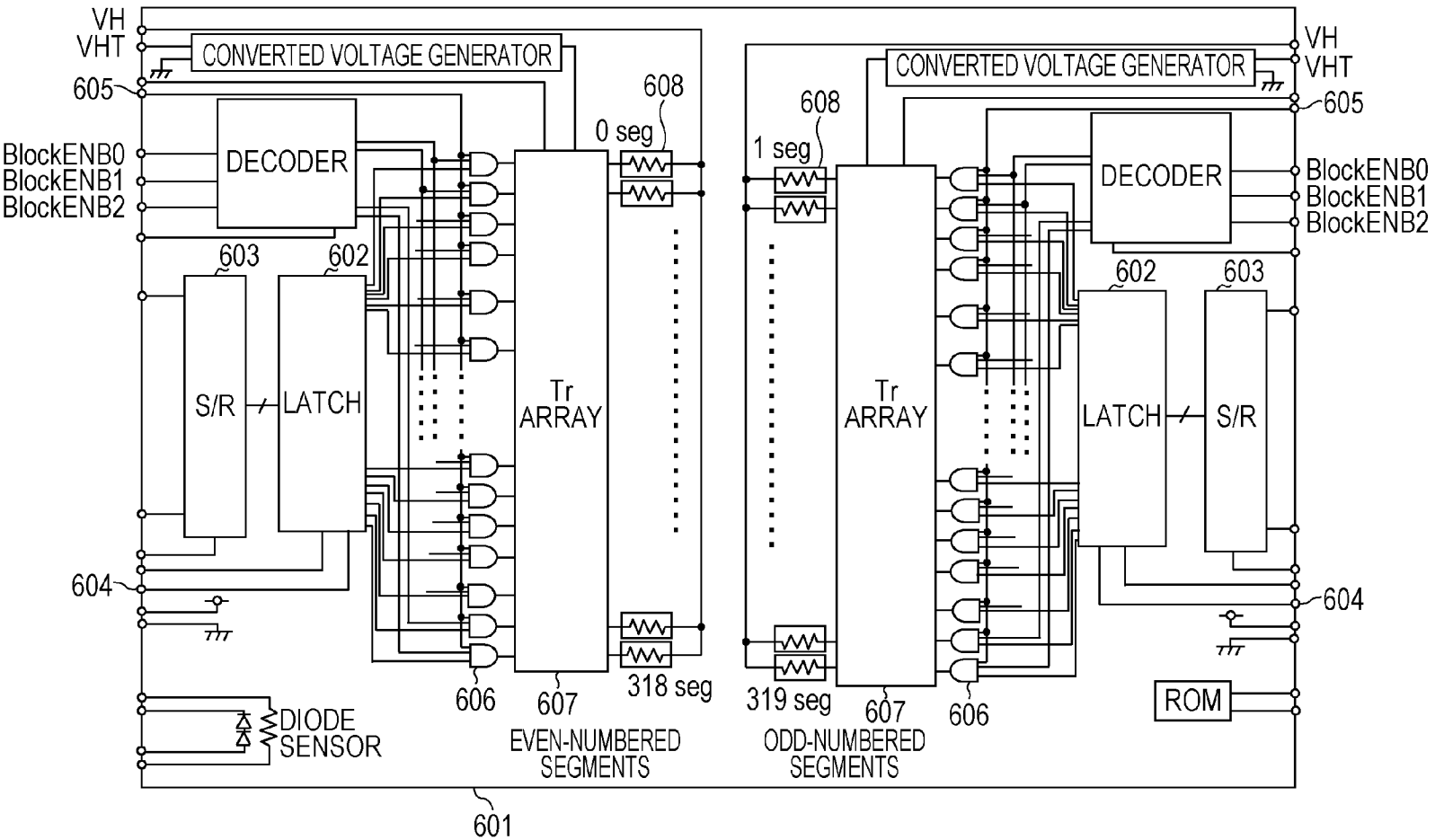
FIG. 4 is a circuit diagram of the liquid discharge head.

FIG. 4 is a circuit diagram illustrating a circuit configuration of the liquid discharge head according to the present embodiment. The liquid discharge head includes a base 601, latch circuits 602 for latching print data, shift registers 603 configured to receive print data in a serial manner in synchronization with a shift clock and hold the data, input terminals 604 for latch signals used to latch print data supplied from a control unit of the liquid discharge apparatus according to the present embodiment, and input terminals 605 for heat pulse signals. Each of the shift registers 603 receives selection data, which will be described later, to be stored in a read-only memory (ROM) in a serial manner and holds the data. Each of the latch circuits 602 latches the selection data.

AND circuits 606 each obtain and output the logical product of a heat pulse signal, a print data signal, a block signal, and selection data. When the output of the AND circuit 606 goes to a level "high (H)", a corresponding heat-generating-resistor driving transistor in a transistor array 607 is turned on. Thus, current flows through a heat generating resistor 608 connected to the transistor, so that the heat generating resistor 608 is driven to generate heat.

An operation of the apparatus including the liquid discharge head with the above-described configuration will now be described in brief.

After the apparatus is turned on, the pulse width of a heat pulse (including a preheat pulse and a main heat pulse) to be applied to each heat generating resistor is determined based on a liquid bubbling level previously measured for the base 601. The liquid bubbling level is obtained by ranking a minimum inkjet pulse value upon predetermined voltage application under constant temperature conditions. Data indicative of the determined width of a heat pulse for each discharge port is transferred to the shift register 603 in synchronization with a shift clock. Then, a voltage signal is output. To actually energize the heat generating resistor 608, driving conditions for the heat generating resistor 608 are selected in accordance with selection data stored in the ROM, as will be described later.

The selection data stored in the ROM is latched by the latch circuit 602. Latching of the selection data may be performed only once when, for example, the apparatus is first activated.

Generation of a heat pulse signal after storage of the selection data in the ROM will now be described. A signal from the ROM is fed back. The pulse width of a heat pulse is then determined based on pulse data selected in response to the signal so that energy proper to liquid discharge is applied to the heat generating resistor 608. In addition, the control unit determines the pulse width of a preheat pulse and the timing of preheat pulse application based on a detection value of a temperature sensor. Various heat pulses can be set so that each discharge port provides a constant amount of liquid discharged under various temperature conditions.

Figure 5:
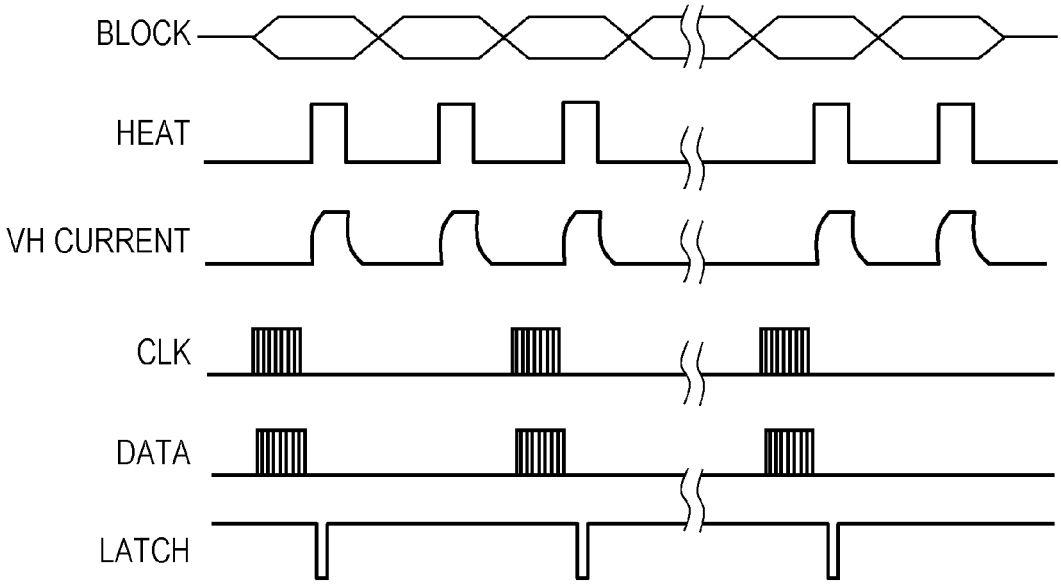
FIG. 5 is a timing chart illustrating driving of the liquid discharge head.

FIG. 5 is a timing chart illustrating driving of the liquid discharge head according to the present embodiment. The latch circuit temporarily holds print information. The shift register receives print information (DATA) supplied in a serial manner from an input terminal in accordance with a transfer clock (CLK) supplied from an input terminal, and outputs the print information (DATA) in a parallel manner to the latch circuit. In the liquid discharge head according to the present embodiment, the shift register is connected to the latch circuit. An output of the shift register is held by the latch circuit at a certain time point. In the liquid discharge head, a plurality of heat generating resistors are divided into multiple groups. The liquid discharge head further includes a heat selection circuit that selects a particular group in accordance with a block enable signal supplied from an input terminal and drives the heat generating resistors. Each AND circuit obtains and outputs the logical product of print data, a heat pulse, and a signal selected and output from the selection circuit to a corresponding driving transistor. When an output signal of the AND circuit goes to the level "H", the corresponding driving transistor is turned on and current flows through the heat generating resistor connected to the driving transistor, so that the heat generating resistor is driven to generate heat. This causes film boiling in the liquid in the flow passage, thus discharging a liquid droplet from the corresponding discharge port. This achieves printing on a recording medium.

<Method of Cleaning Liquid Discharge Head>

To remove kogation deposited on the surface of the covering portion 107*a*, the liquid discharge head 1 which has been driven a predetermined number of times is subjected to a cleaning process. Voltage is first applied so that the covering portion 107*a* is at a positive potential relative to the liquid and the electrode 107*b* is at a negative potential relative to the liquid in the liquid discharge head 1. Consequently, an electrochemical reaction is caused between the liquid containing the electrolyte and the covering portion 107*a*, serving as a positive electrode, so that the surface of the covering portion 107*a* is dissolved in the liquid and the kogation deposited thereon is thus diffused into the liquid. However, if pigment particles contained in the liquid are charged negatively, the pigment particles would be adsorbed onto the surface of the covering portion 107*a*, serving as a positive electrode. If the cleaning process is terminated in such a state, the liquid would be discharged unstably.

To prevent such unstable discharge, a first voltage application step of applying voltage between the covering portion 107*a* and the electrode 107*b* of the liquid discharge head 1 through the liquid is performed. Then, a second voltage application step of reversing the polarities of the electrodes relative to the liquid and again applying voltage between the electrodes such that energy applied is substantially equal to that in the first voltage application step is performed. In the present embodiment, a combination of the first voltage application step and the second voltage application step corresponds to one voltage reversal application operation, and the voltage reversal application operation is performed multiple times in one cleaning process. The voltage reversal application operation is repeated while voltage application conditions are changed such that energy applied is less than energy applied in the immediately preceding voltage reversal application operation. Specifically, the duration of voltage application (hereinafter, "voltage application duration") or a voltage applied is reduced. Both the voltage application duration and a voltage applied can be changed.

Repeating the voltage reversal application operation while changing the voltage application conditions such that energy applied is less than energy applied in the immediately preceding operation can reduce the number of pigment particles, contained in the liquid, adsorbed on the surface of the covering portion 107*a* or the electrode 107*b*.

The cleaning process can be terminated such that energy applied in the last voltage reversal application operation of the cleaning process is less than energy applied in the immediately preceding operation. To reduce the number of pigment particles adsorbed on the surface of the covering portion 107*a* or the electrode 107*b*, energy applied in at least one voltage reversal application operation may be made less than that in the immediately preceding operation.

The voltage reversal application operation can be performed multiple times such that energy applied is reduced in the above-described manner. Since the number of pigment particles adsorbed on the surface of the covering portion 107*a* or the electrode 107*b* is gradually reduced, the adsorption of the pigment particles can be further reduced.

Furthermore, the voltage reversal application operation can be performed such that energy applied is 50% to 90% of energy applied in the immediately preceding voltage reversal application operation.

In repeating the voltage reversal application operation, the cleaning process can be terminated without reversing the polarities of the electrodes in the last voltage reversal application operation.

First Embodiment

Figure 7A:
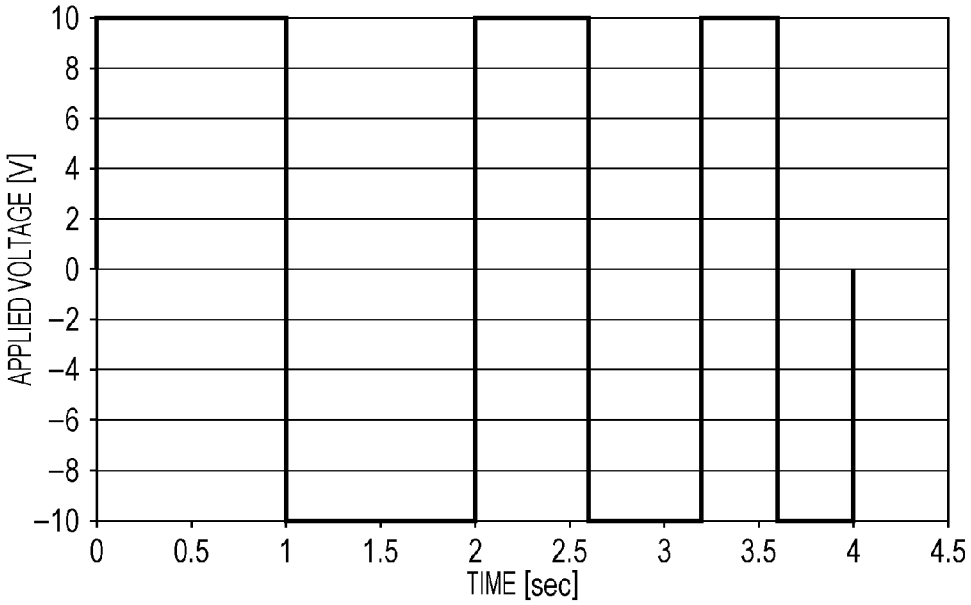
FIGS. 7A and 7B are graphs illustrating voltages applied in a cleaning process according to a first embodiment.
Figure 7B:
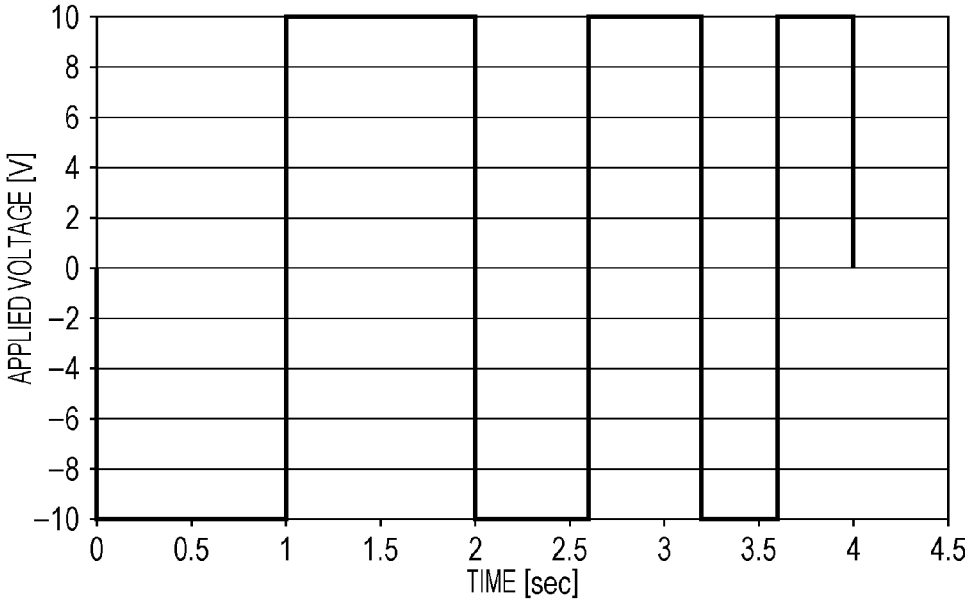

FIGS. 7A and 7B are graphs illustrating voltage application conditions (voltage and voltage application duration) in a cleaning process according to a first embodiment. FIG. 7A illustrates the voltage application conditions for the covering portion 107*a*. FIG. 7B illustrates the voltage application conditions for the electrode 107*b*. Table 1 illustrates specific voltage application conditions corresponding to the graphs of FIGS. 7A and 7B in the cleaning process according to the present embodiment.

TABLE 1

| | Covering Portion 107a | | Electrode 107b | |
|---|---|---|---|---|
| Voltage Application | Applied Voltage [V] | Application Duration [sec] | Applied Voltage [V] | Application Duration [sec] |
| 1st | +10.0 | 1.0 | −10.0 | 1.0 |
| 2nd | −10.0 | 1.0 | +10.0 | 1.0 |

TABLE 1-continued

| | Covering Portion 107a | | Electrode 107b | |
|---|---|---|---|---|
| Voltage Application | Applied Voltage [V] | Application Duration [sec] | Applied Voltage [V] | Application Duration [sec] |
| 3rd | +10.0 | 0.6 | −10.0 | 0.6 |
| 4th | −10.0 | 0.6 | +10.0 | 0.6 |
| 5th | +10.0 | 0.4 | −10.0 | 0.4 |
| 6th | −10.0 | 0.4 | +10.0 | 0.4 |

FIGS. 7A and 7B illustrate a case where a voltage reversal application operation of applying voltage so that the covering portion 107*a* serves as a positive electrode and the electrode 107*b* serves as a negative electrode in the liquid discharge head 1, then reversing the polarities of the electrodes, and applying voltage is repeated while the voltage application duration is gradually reduced. The absolute value of a voltage applied in this process is fixed. Since the voltage application duration is reduced to reduce energy applied, the cleaning process can be performed in a short time. Voltages applied to the covering portion 107*a* and the electrode 107*b* are relative to the potential of the liquid.

Surface states of the covering portion 107*a* and the electrode 107*b* subjected to the cleaning process under the conditions in FIGS. 7A and 7B will now be described. FIGS. 6A to 6H are diagrams explaining the removal of kogation deposited on the covering portion 107*a* and states of pigment particles contained in the liquid in the cleaning process under the conditions in FIGS. 7A and 7B.

Figure 6A:
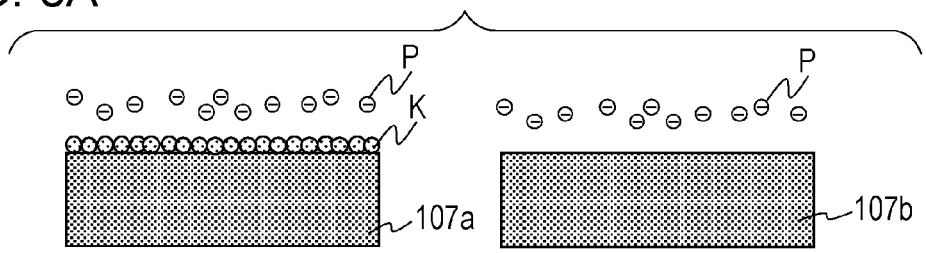
FIGS. 6A to 6H are schematic diagrams explaining surface states of a covering portion and an electrode subjected to a cleaning process in an embodiment of the present invention.

As the liquid discharge head is used, kogation, indicated at K, deposits on the surface of the covering portion 107*a*. The pigment particles, indicated at P, contained in the liquid and charged negatively are suspended in the flow passage (FIG. 6A).

Figure 6B:
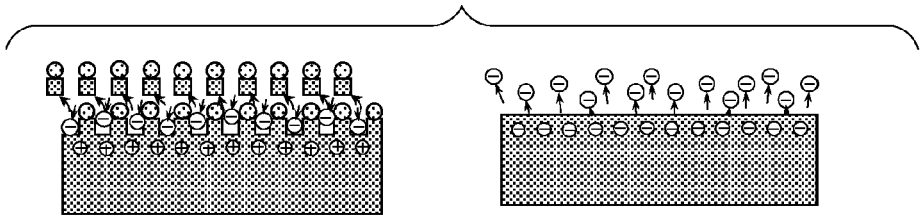

To remove the kogation, a voltage of +10 V is applied to the covering portion 107*a* and a voltage of −10 V is applied to the electrode 107*b* for one second. This causes an electrochemical reaction between the covering portion 107*a* and the liquid containing the electrolyte, so that iridium, serving as a material of the covering portion 107*a*, is dissolved in the liquid. Additionally, the kogation deposited on the surface of the covering portion 107*a* is simultaneously removed from the surface thereof. Since the covering portion 107*a* serves as a positive electrode, the pigment particles charged negatively are attracted to and adsorbed onto the surface of the covering portion 107*a* (FIG. 6B).

Figure 6C:
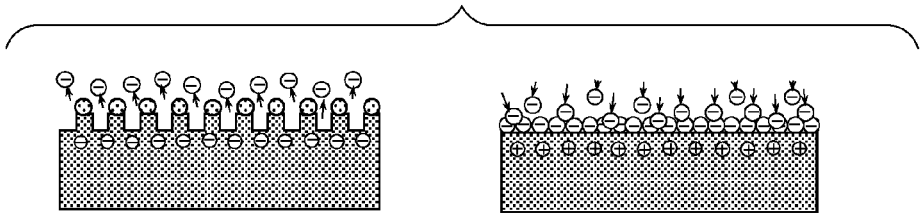

To remove the pigment particles, adsorbed on the surface of the covering portion 107*a*, from the surface thereof, a voltage of −10 V is applied to the covering portion 107*a* and a voltage of +10 V is applied to the electrode 107*b* for one second. Thus, the pigment particles adsorbed on the covering portion 107*a* are diffused into the liquid. Furthermore, the pigment particles charged negatively are attracted to and adsorbed onto the surface of the electrode 107*b*, serving as a positive electrode (FIG. 6C).

Figure 6D:
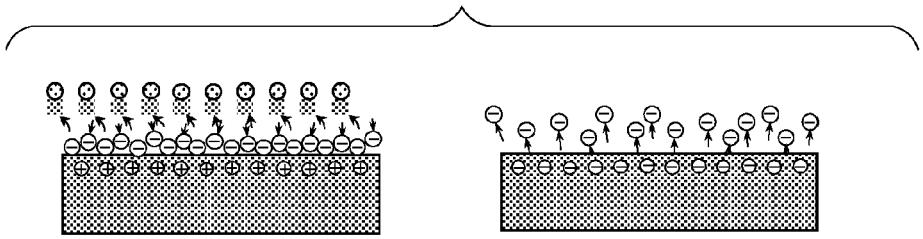

Then, a voltage of +10 V is applied to the covering portion 107*a* and a voltage of −10 V is applied to the electrode 107*b* for 0.6 seconds. Thus, the pigment particles adsorbed on the surface of the electrode 107*b* are diffused into the liquid. Furthermore, the pigment particles are again attracted to and adsorbed onto the surface of the covering portion 107*a*. At this time, the surface of the covering portion 107*a* is dissolved in the liquid, so that the kogation left in the preceding voltage reversal application operation is removed (FIG. 6D).

Figure 6E:
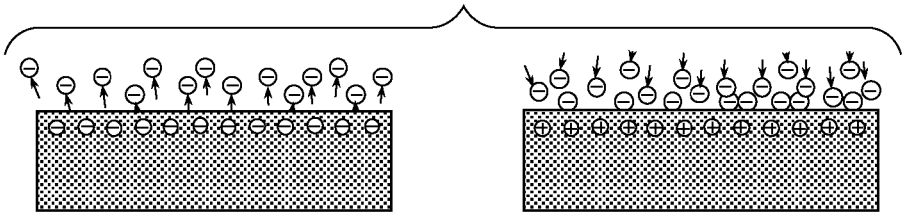

Then, a voltage of −10 V is applied to the covering portion 107*a* and a voltage of +10 V is applied to the electrode 107*b* for 0.6 seconds. Thus, the pigment particles adsorbed on the surface of the covering portion 107*a* are diffused into the liquid. Furthermore, the pigment particles are attracted to and adsorbed onto the surface of the electrode 107*b* (FIG. 6E).

Figure 6F:
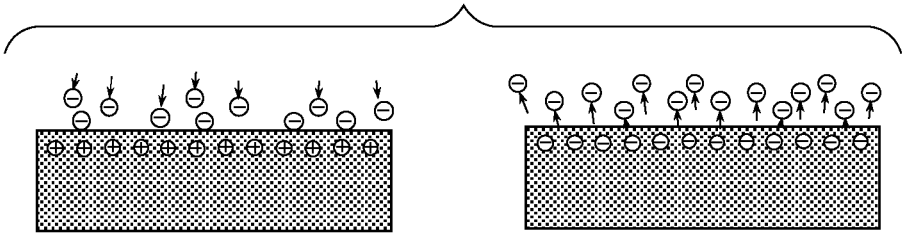

Then, a voltage of +10 V is applied to the covering portion 107*a* and a voltage of −10 V is applied to the electrode 107*b* for 0.4 seconds. Thus, the pigment particles adsorbed on the surface of the electrode 107*b* are diffused into the liquid. Furthermore, the pigment particles are attracted to and adsorbed onto the surface of the covering portion 107*a* (FIG. 6F).

Figure 6G:
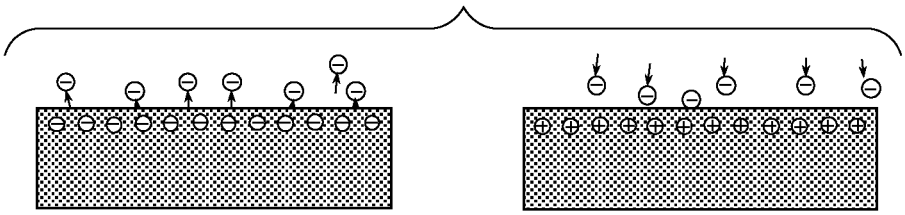

Then, a voltage of −10 V is applied to the covering portion 107*a* and a voltage of +10 V is applied to the electrode 107*b* for 0.4 seconds. Thus, the pigment particles adsorbed on the surface of the covering portion 107*a* are diffused into the liquid. Furthermore, the pigment particles are attracted to and adsorbed onto the surface of the electrode 107*b* (FIG. 6G).

Figure 6H:
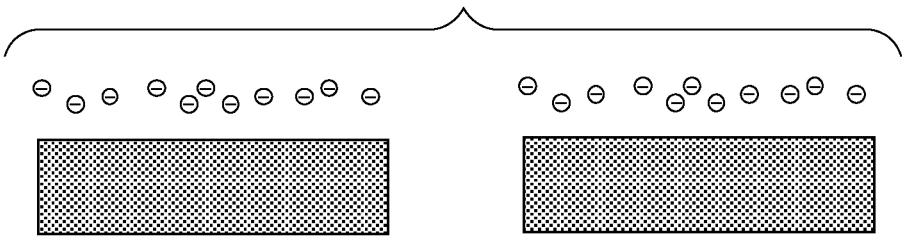

As described above, the operation of applying voltages to the electrodes, then reversing the polarities of the electrodes, and applying the voltages to the electrodes is repeated while the voltage application duration is gradually reduced. Consequently, the number of pigment particles adsorbed on the surface of the covering portion 107*a* or the electrode 107*b* is gradually reduced. This results in a state in which the pigment particles are hardly adsorbed at the end of the cleaning process as illustrated in FIG. 6H.

In the present embodiment, the cleaning process is performed such that energy applied in the first voltage application step is substantially equal to that in the second voltage application step of one voltage reversal application operation. Consequently, the pigment particles adsorbed on the surface of either the covering portion 107*a* or the electrode 107*b* can be diffused from the surface into the liquid. The voltage application can be performed as in the present embodiment.

It is not necessary that energy applied in the first voltage application step should be substantially equal to that in the second voltage application step in one voltage reversal application operation as in the present embodiment. In other words, if energy applied in the second voltage application step is less than energy applied in the first voltage application step in one voltage reversal application operation, the adsorbed pigment particles can be diffused into the liquid. The first voltage application step and the second voltage application step of reversing the polarities of the covering portion 107*a* and the electrode 107*b* and applying voltage may be alternately performed multiple times such that energy applied in the second voltage application step at least one time is less than energy applied in the first voltage application step of the immediately preceding time. For example, in Table 1, applied voltages may be set as illustrated in Table 1 and the application duration may be gradually reduced in descending order from the first voltage application stage to the sixth voltage application stage.

In the present embodiment, voltages are applied to the covering portion 107*a* and the electrode 107*b* such that one of the covering portion 107*a* and the electrode 107*b* is at a positive potential and the other one of them is at a negative potential. Voltage may be applied as follows: the first voltage application step is performed such that the covering portion 107*a* is at a positive potential and the electrode 107*b* is at a ground potential and the second voltage application step is then performed such that the covering portion 107*a* is at the ground potential and the electrode 107*b* is at a positive potential. Specifically, after the first voltage application step, the second voltage application step is performed such that the relative polarities of the covering portion 107*a* and the electrode 107*b* in the first voltage application step are reversed. While the first voltage application step and the second voltage application step are repeated, applied voltages may be reduced or the voltage application duration may be reduced as described above. With the above-described voltage application, the number of pigment particles adsorbed on the surface of the covering portion 107*a* or the electrode 107*b* can be gradually reduced. This can result in a state in which the pigment particles are hardly adsorbed at the end of the cleaning process.

Second Embodiment

Figure 8A:
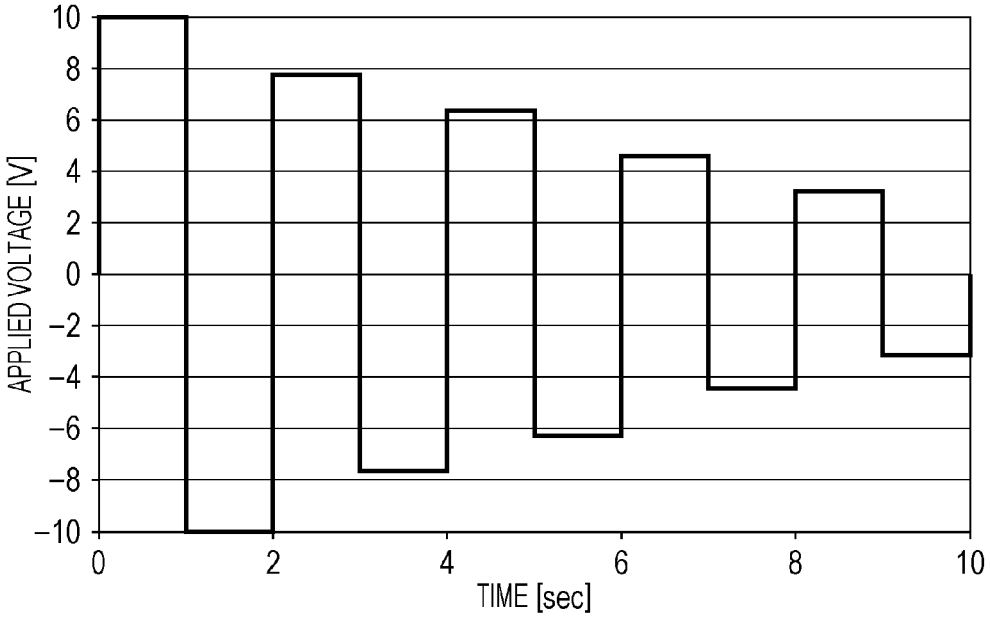
FIGS. 8A and 8B are graphs illustrating voltages applied in a cleaning process according to a second embodiment.
Figure 8B:
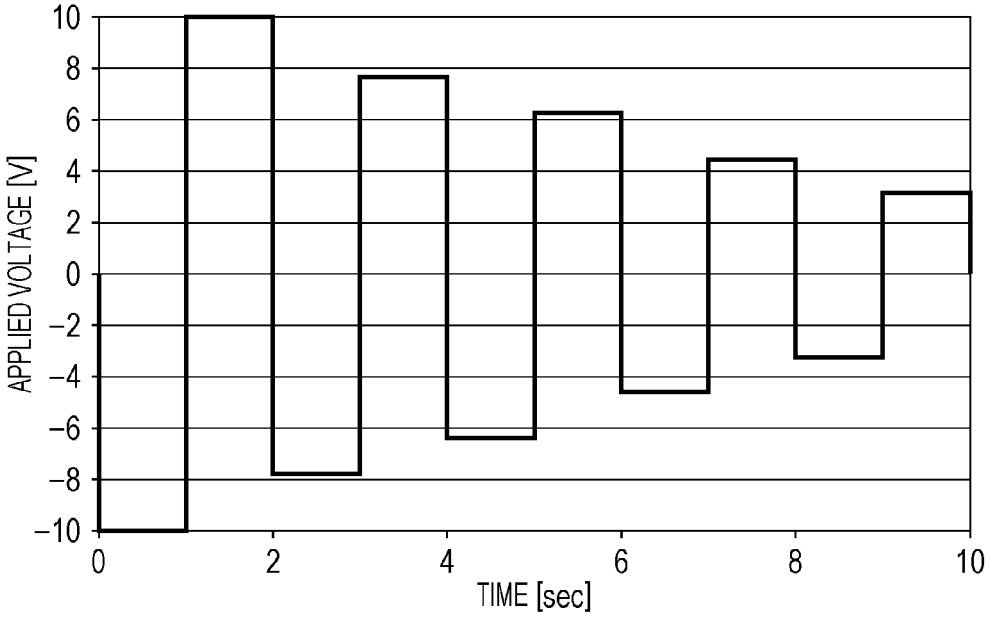

FIGS. 8A and 8B are graphs illustrating voltage application conditions (voltage and voltage application duration) in a cleaning process according to a second embodiment. FIG. 8A illustrates voltage application conditions for the covering portion 107*a*. FIG. 8B illustrates voltage application conditions for the electrode 107*b*. Table 2 illustrates specific voltage application conditions corresponding to the graphs of FIGS. 8A and 8B in the cleaning process according to the second embodiment.

TABLE 2

| | Covering Portion 107a | | Electrode 107b | |
|---|---|---|---|---|
| Voltage Application | Applied Voltage [V] | Application Duration [sec] | Applied Voltage [V] | Application Duration [sec] |
| 1st | +10.0 | 1.0 | −10.0 | 1.0 |
| 2nd | −10.0 | 1.0 | +10.0 | 1.0 |
| 3rd | +7.7 | 1.0 | −7.7 | 1.0 |
| 4th | −7.7 | 1.0 | +7.7 | 1.0 |
| 5th | +6.3 | 1.0 | −6.3 | 1.0 |
| 6th | −6.3 | 1.0 | +6.3 | 1.0 |
| 7th | +4.5 | 1.0 | −4.5 | 1.0 |
| 8th | −4.5 | 1.0 | +4.5 | 1.0 |
| 9th | +3.2 | 1.0 | −3.2 | 1.0 |
| 10th | −3.2 | 1.0 | +3.2 | 1.0 |

FIGS. 8A and 8B illustrate a case where a voltage reversal application operation of applying voltage so that the covering portion 107*a* serves as a positive electrode and the electrode 107*b* serves as a negative electrode in the liquid discharge head 1, then reversing the polarities of the electrodes, and applying voltage is repeated while the absolute value of a voltage applied is gradually reduced. The voltage application duration is fixed.

Third Embodiment

Figure 9A:
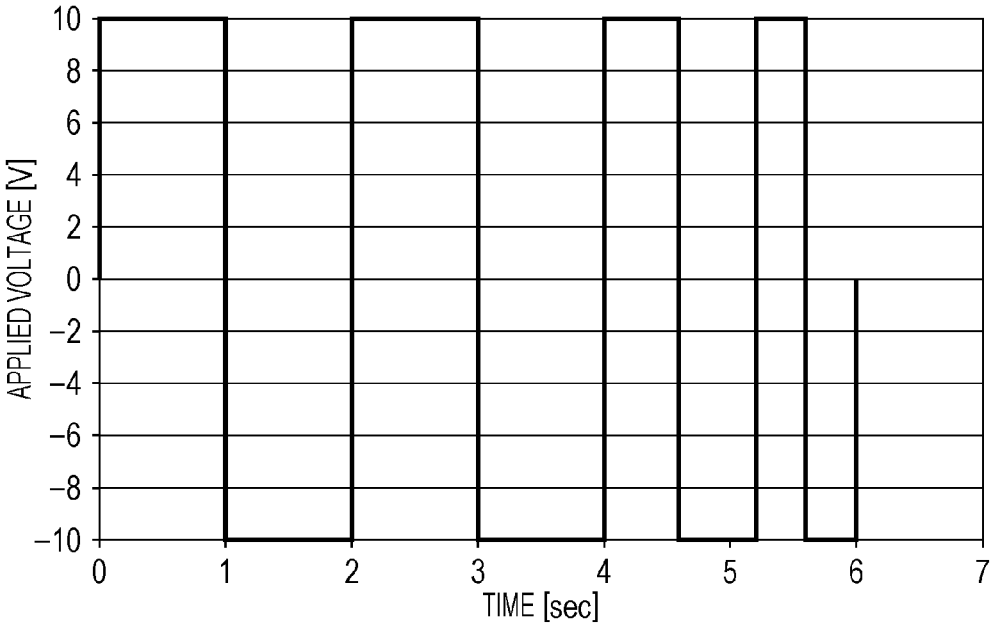
FIGS. 9A and 9B are graphs illustrating voltages applied in a cleaning process according to a third embodiment.
Figure 9B:
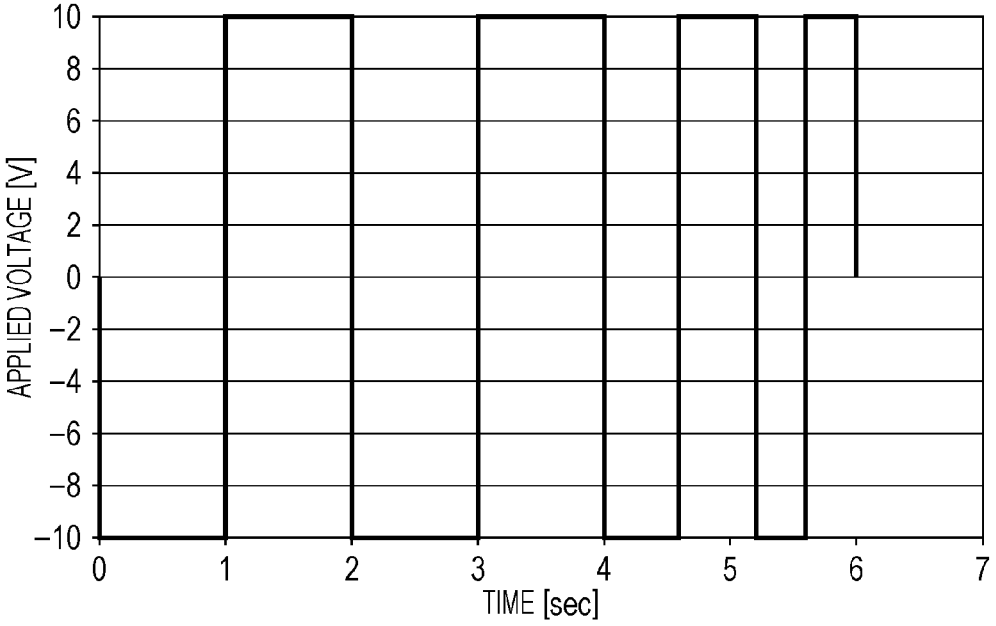

FIGS. 9A and 9B are graphs illustrating voltage application conditions (voltage and voltage application duration) in a cleaning process according to a third embodiment. FIG. 9A illustrates voltage application conditions for the covering portion 107*a*. FIG. 9B illustrates voltage application conditions for the electrode 107*b*. Table 3 illustrates specific voltage application conditions corresponding to the graphs of FIGS. 9A and 9B in the cleaning process according to the present embodiment.

TABLE 3

| Voltage Application | Covering Portion 107a Applied Voltage [V] | Covering Portion 107a Application Duration [sec] | Electrode 107b Applied Voltage [V] | Electrode 107b Application Duration [sec] |
|---|---|---|---|---|
| 1st | +10.0 | 1.0 | −10.0 | 1.0 |
| 2nd | −10.0 | 1.0 | +10.0 | 1.0 |
| 3rd | +10.0 | 1.0 | −10.0 | 1.0 |
| 4th | −10.0 | 1.0 | +10.0 | 1.0 |
| 5th | +10.0 | 0.6 | −10.0 | 0.6 |
| 6th | −10.0 | 0.6 | +10.0 | 0.6 |
| 7th | +10.0 | 0.4 | −10.0 | 0.4 |
| 8th | −10.0 | 0.4 | +10.0 | 0.4 |

FIGS. 9A and 9B illustrate a case where a voltage reversal application operation of applying voltage so that the covering portion 107*a* serves as a positive electrode and the electrode 107*b* serves as a negative electrode in the liquid discharge head 1, then reversing the polarities of the electrodes, and applying voltage is repeated under constant voltage application conditions. After that, the voltage reversal application operation is repeated while the voltage application conditions are changed such that energy applied is reduced. In the case of FIGS. 9A and 9B, the voltage application duration is gradually reduced.

In the present embodiment, the voltage reversal application operation is repeated under constant voltage application conditions as described above, thus reliably removing kogation deposited on the covering portion 107*a*. After that, the voltage application duration is reduced to reduce the adsorption of pigment particles onto the surface of the covering portion 107*a* or the electrode 107*b*. According to the present embodiment, if a large amount of kogation is deposited on the covering portion 107*a*, the kogation can be reliably removed.

EXAMPLES

In order to verify the advantages of the above-described embodiments, the heat generating resistor 104*a* was driven a predetermined number of times so that kogation was deposited onto the covering portion 107*a* and, after that, a liquid discharge head cleaning process according to each of the above-described embodiments was performed as Example, which will be described below. In addition, a cleaning process in which a voltage reversal application operation was repeated under constant voltage application conditions was performed as Comparative Example. In Examples and Comparative Example, PGI-73C (pigment ink manufactured by CANON KABUSHIKI KAISHA) was used as ink. The results of verification will be described later. The present inventors confirmed that similar results were obtained in the use of different color inks.

Example 1-1

A liquid discharge head cleaning process was performed such that the first to fourth voltage application stages (i.e., two voltage reversal application operations) were performed under the conditions illustrated in Table 1 in the first embodiment.

At the completion of the cleaning process, kogation deposited on the surface of the covering portion 107*a* was removed and pigment particles were not adsorbed on the surface. Although a small amount of pigment particles was adsorbed on the surface of the electrode 107*b*, the adsorption of the pigment particles on the surface of the electrode 107*b* was less than that in Comparative Example. The advantages of the first embodiment were verified.

Example 1-2

A liquid discharge head cleaning process was performed such that the first to sixth voltage application stages (i.e., three voltage reversal application operations) were performed under the conditions illustrated in Table 1 in the first embodiment.

At the completion of the cleaning process, kogation deposited on the surface of the covering portion 107*a* was removed and pigment particles were not adsorbed on the surface. Furthermore, the pigment particles were not adsorbed on the surface of the electrode 107*b*. Before the cleaning process, the liquid was discharged at a rate of 7 m/s. After the cleaning process, the discharge rate was 15 m/s, which is substantially equal to an initial discharge rate. Furthermore, it was confirmed that a discharged liquid droplet was landed at an intended position and good print quality was achieved.

Example 2

A liquid discharge head cleaning process was performed such that the first to tenth voltage application stages (i.e., five voltage reversal application operations) were performed under the conditions illustrated in Table 2 in the second embodiment.

At the completion of the cleaning process, kogation deposited on the surface of the covering portion 107*a* was removed and pigment particles were not adsorbed on the surface. Furthermore, the pigment particles were not adsorbed on the surface of the electrode 107*b*. Before the cleaning process, the liquid was discharged at a rate of 7 m/s. After the cleaning process, the discharge rate was 15 m/s, which is substantially equal to an initial discharge rate. Furthermore, it was confirmed that a discharged liquid droplet was landed at an intended position and good print quality was achieved.

Example 3

A liquid discharge head cleaning process was performed such that the first to eighth voltage application stages (i.e., four voltage reversal application operations) were performed under the conditions illustrated in Table 3 in the third embodiment.

At the completion of the cleaning process, kogation deposited on the surface of the covering portion 107*a* was removed and pigment particles were not adsorbed on the surface. Furthermore, the pigment particles were not adsorbed on the surface of the electrode 107*b*. Before the cleaning process, the liquid was discharged at a rate of 7 m/s. After the cleaning process, the discharge rate was 15 m/s, which is substantially equal to an initial discharge rate. Furthermore, it was confirmed that a discharged liquid droplet was landed at an intended position and good print quality was achieved.

Comparative Example

Figure 10A:
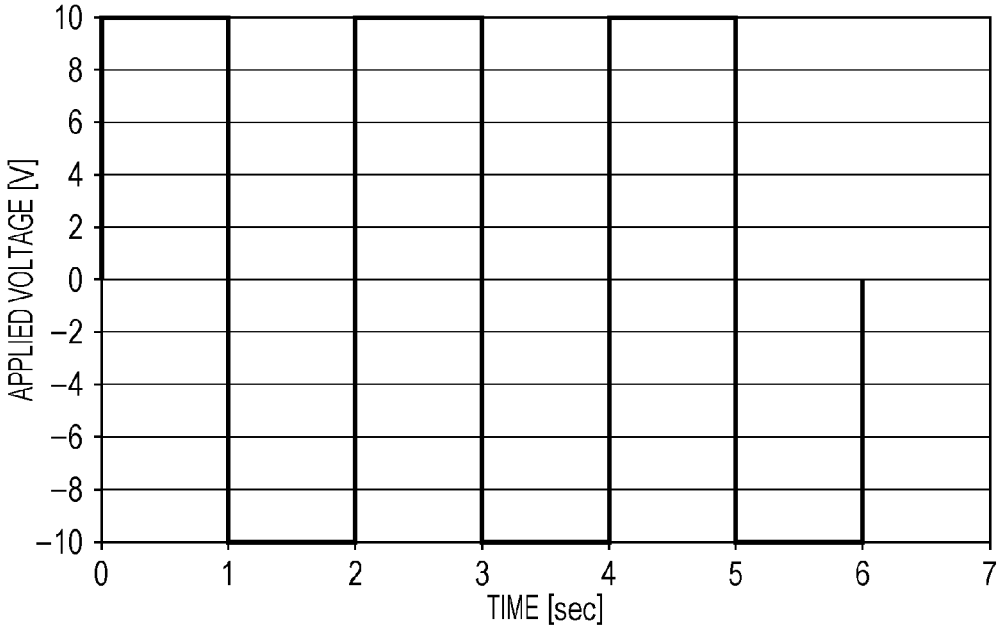
FIGS. 10A and 10B are graphs illustrating voltages applied in a cleaning process according to Comparative Example.
Figure 10B:
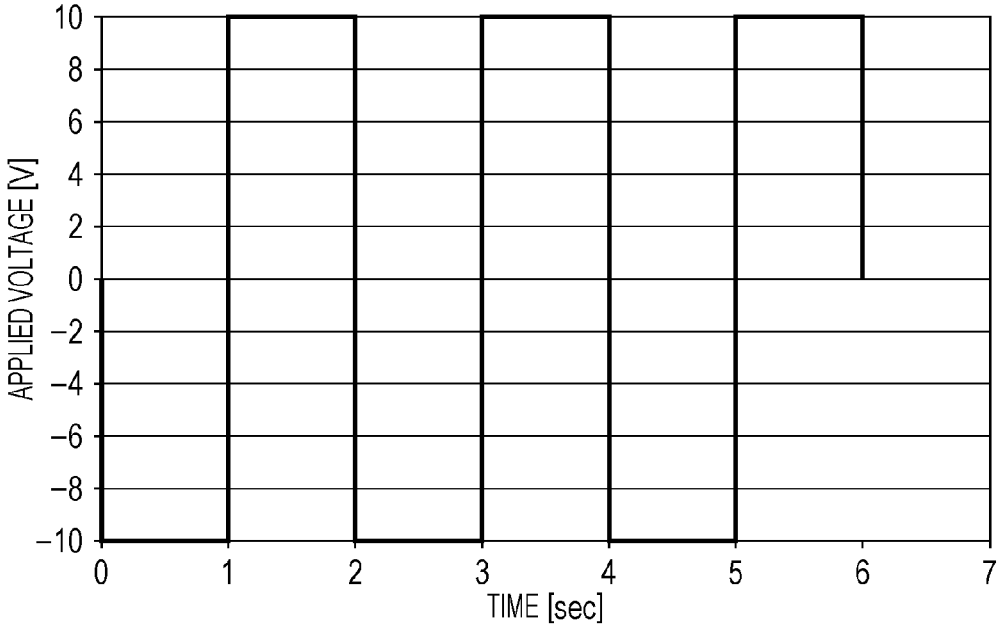

A liquid discharge head cleaning process was performed such that the first to sixth voltage application stages (i.e., three voltage reversal application operations) were performed under conditions illustrated in FIGS. 10A and 10B.

The voltage application conditions for the respective voltage application stages were the same. Specifically, a voltage of +10 V and a voltage of −10 V were set and the application duration was set to one second.

At the completion of the cleaning process, pigment particles were attracted to and adsorbed on the surface of the electrode 107*b*.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-176065, filed Sep. 7, 2015, which is hereby incorporated by reference herein in its entirety.

What is claimed is:

1. A method of cleaning a liquid discharge head that includes a heat generating resistor that generates thermal energy for discharging a liquid and a covering portion covering the heat generating resistor, the method comprising:

alternately performing a first voltage application process and a second voltage application process multiple times, wherein the first voltage application process includes applying voltage between the covering portion and an electrode through the liquid to dissolve the covering portion in the liquid, and wherein the second voltage application process includes reversing relative polarities of the covering portion and the electrode in the first voltage application process and applying voltage between the covering portion and the electrode; and reducing energy applied in the second voltage application process at least one time such that the energy applied is less than energy applied in the first voltage application process of an immediately preceding time.

2. The method according to claim 1, wherein reducing includes reducing voltage application duration.

3. The method according to claim 1, wherein reducing includes reducing a voltage applied.

4. The method according to claim 1, wherein the first voltage application process and the second voltage application process are alternately performed multiple times while energy applied is gradually reduced.

5. The method according to claim 1, wherein the covering portion comprises iridium or ruthenium.

6. The method according to claim 1, wherein the electrode comprises iridium or ruthenium.

7. A method of cleaning a liquid discharge head that includes a heat generating resistor that generates thermal energy for discharging a liquid and a covering portion covering the heat generating resistor, the method comprising:

performing a voltage reversal application operation multiple times, wherein the voltage reversal application operation includes a first voltage application process and a second voltage application process, wherein the first voltage application process includes applying voltage between the covering portion and an electrode through the liquid to dissolve the covering portion in the liquid, and wherein the second voltage application process includes reversing relative polarities of the covering portion and the electrode in the first voltage application process after the first voltage application process and applying voltage between the covering portion and the electrode such that energy applied is substantially equal to that in the first voltage application process; and reducing energy applied in at least one voltage reversal application operation such that the energy applied is less than energy applied in an immediately preceding voltage reversal application operation.

8. The method according to claim 7, wherein reducing includes reducing voltage application duration.

9. The method according to claim 7, wherein reducing includes reducing a voltage applied.

10. The method according to claim 7, wherein the voltage reversal application operation is performed multiple times while energy applied is gradually reduced.

11. The method according to claim 7, wherein the voltage reversal application operation is performed multiple times such that energy applied is substantially constant and, after that, the voltage reversal application operation is performed multiple times while energy applied is gradually reduced.

12. The method according to claim 7, wherein the voltage reversal application operation is performed such that energy applied is less than energy applied in the immediately preceding voltage reversal application operation and cleaning the liquid discharge head is then terminated.

13. The method according to claim 7, wherein the covering portion comprises iridium or ruthenium.

14. The method according to claim 7, wherein the electrode comprises iridium or ruthenium.

15. A liquid discharge apparatus comprising:

a liquid discharge head that includes a heat generating resistor that generates thermal energy for discharging a liquid and a covering portion covering the heat generating resistor, wherein the liquid discharge apparatus is configured to alternately perform a first voltage application process and a second voltage application process multiple times, wherein the first voltage application process includes applying voltage between the covering portion and an electrode through the liquid to dissolve the covering portion in the liquid, and wherein the second voltage application process includes reversing relative polarities of the covering portion and the electrode in the first voltage application process and applying voltage between the covering portion and the electrode, and wherein the liquid discharge apparatus is configured to reduce energy applied in the second voltage application process at least one time such that the energy applied is less than energy applied in the first voltage application process of an immediately preceding time.

16. The liquid discharge apparatus according to claim 15, wherein the liquid discharge apparatus is configured to alternately perform the first voltage application process and the second voltage application process multiple times while energy applied is gradually reduced.

17. A liquid discharge apparatus comprising:

a liquid discharge head that includes a heat generating resistor that generates thermal energy for discharging a liquid and a covering portion covering the heat generating resistor, wherein the liquid discharge apparatus is configured to perform a voltage reversal application operation multiple times, wherein the voltage reversal application operation includes a first voltage application process and a second voltage application process, wherein the first voltage application process includes applying voltage between the covering portion and an electrode through the liquid to dissolve the covering portion in the liquid, and wherein the second voltage application process includes reversing relative polarities of the covering portion and the electrode in the first voltage application process after the first voltage application process and applying voltage between the covering portion and the electrode such that energy applied is substantially equal to that in the first voltage application process, and wherein the liquid discharge apparatus is configured to reduce energy applied in at least one voltage reversal application operation such that the energy applied is less than energy applied in an immediately preceding voltage reversal application operation.

18. The liquid discharge apparatus according to claim 17, wherein the liquid discharge apparatus is configured to perform the voltage reversal application operation multiple times while energy applied is gradually reduced.

19. The liquid discharge apparatus according to claim 17, wherein the liquid discharge apparatus is configured to perform the voltage reversal application operation multiple times such that energy applied is substantially constant and, after that, perform the voltage reversal application operation multiple times while energy applied is gradually reduced.

* * * * *